US005858090A

United States Patent [19]

Gottwald

[11] Patent Number: 5,858,090

[45] Date of Patent: Jan. 12, 1999

[54] APPARATUS FOR THE APPLICATION OF A LIQUID OR PASTY MEDIUM ONTO A MOVING MATERIAL WEB, IN PARTICULAR OF PAPER OR BOARD

[75] Inventor: Ingo Gottwald, Steinheim, Germany

[73] Assignee: Voith Sulzer Papiermaschinen GmbH, Germany

[21] Appl. No.: 573,322

[22] Filed: Dec. 15, 1995

[30] Foreign Application Priority Data

Dec. 15, 1994 [DE] Germany ..... 44 44 779.5

[51] Int. Cl.[6] ..... B05C 11/02

[52] U.S. Cl. ..... 118/119; 118/413; 118/126

[58] Field of Search ..... 118/410, 413, 118/419, 261, 123, 126, 117, 118, 119, 414; 101/425; 427/356; 15/256.51

[56] References Cited

U.S. PATENT DOCUMENTS

| | | | |
|---|---|---|---|
| 2,970,564 | 2/1961 | Warner | 118/262 |
| 3,817,208 | 6/1974 | Barnscheidt et al. | 118/119 |
| 4,282,826 | 8/1981 | Wohlfeil | 118/118 |
| 4,773,351 | 9/1988 | Sollinger | 118/119 |
| 4,839,201 | 6/1989 | Rantanen et al. | 118/413 |
| 5,078,081 | 1/1992 | Kustermann | 118/119 |
| 5,173,120 | 12/1992 | Suzumura et al. | 118/410 |
| 5,328,511 | 7/1994 | Beisswanger | 118/203 |

FOREIGN PATENT DOCUMENTS

| | | |
|---|---|---|
| 0319503 | 2/1988 | European Pat. Off. . |
| 571849 | 12/1993 | European Pat. Off. . |
| 0677613 | 4/1995 | European Pat. Off. . |
| 93521 | 1/1995 | Finland . |
| 95300 | 9/1995 | Finland . |
| 96339 | 2/1996 | Finland . |
| 1324762 | 7/1973 | United Kingdom . |
| 1410824 | 10/1975 | United Kingdom . |

*Primary Examiner*—Brenda A. Lamb
*Attorney, Agent, or Firm*—Ostrolenk, Faber, Gerb & Soffen, LLP

[57] ABSTRACT

An apparatus for applying a liquid or pasty medium, i.e. a coating medium onto a moving material web, in particular consisting of paper or board. At least one application unit applies the medium. A roll associated with the application unit receives the medium. The application unit has an application doctor blade and has a cleaning doctor blade which is arranged at a distance from the application doctor blade in the direction opposite the direction of rotation of the roll. The cleaning doctor blade together with the application doctor blade defines an application chamber for the medium. In order to prevent the collection and build-up of fibers, foreign bodies and similar particles upstream of or on the entrance side of the cleaning doctor blade, as far as possible, the cleaning doctor blade is equipped with a blade bar which is supported by a holder. The holder has openings or channels for the discharge of the medium out of the application chamber in the direction opposite the direction of rotation of the roll and contacting the roll before it is exposed to the medium from the application chamber. The blade bar of the cleaning doctor blade is driven to rotate. The application doctor blade also has a blade bar that is driven to rotate.

12 Claims, 3 Drawing Sheets

APPARATUS FOR THE APPLICATION OF A LIQUID OR PASTY MEDIUM ONTO A MOVING MATERIAL WEB, IN PARTICULAR OF PAPER OR BOARD

BACKGROUND OF THE INVENTION

The present invention relates to an apparatus for the application of a liquid or pasty medium, particularly a coating medium, onto a moving material web, in particular consisting of paper or board.

The apparatus includes at least one application unit for applying the liquid or pasty medium and a roll associated with the application unit wherein the roll to take up the liquid or pasty medium in the case of indirect application to the web, or the roll guides the material web past the application unit in the case of direct application of the medium to the web. The application unit has an application doctor blade which doctors the applied medium after it passes by the coating medium application chamber and a cleaning doctor blade which is arranged at a distance from the application doctor blade in the direction opposite the direction of rotation of the roll. The cleaning doctor blade together with the application doctor blade define boundaries of the application chamber for the liquid or pasty medium. Openings or channels are provided through which the liquid or pasty medium is discharged from the application chamber, essentially against the direction of the rotation of the roll. The liquid or pasty medium impinges at least partially outside the application chamber upon the surface region of the roll or material web, respectively, adjacent the cleaning doctor blade.

By means of apparatus; of this type, a liquid or pasty medium, particularly a coating medium, is applied in the form of color, impregnating liquid, starch, or the like onto the material web. The material web can consist of paper, or board or even of a textile material. The liquid or pasty medium can be applied onto the moving material web either directly or indirectly. In the case of direct application, the material web, lying on the shell surface of the roll, is passed by the application unit. The liquid or pasty medium is there applied directly on the web by the application doctor blade in the region of the application chamber and is applied onto the material web in the form of a coating film. The roll there serves as a counter-roll for the application unit. On the contrary, in indirect application on the web, the liquid or pasty medium is initially applied onto the surface of the roll and is subsequently taken up by the material web which is led past and in contact with the roll.

For achieving optimal quality both in direct and indirect applications, it is necessary that an absolutely uniform coating film be produced on the material web. However, the absolutely uniform formation of the coating film is prevented in practice if web components such as fibers, foreign bodies or dirt particles collect between the application doctor blade which is at the downstream or exit end of the application chamber and the roll surface of the web surface. In such cases, so-called blade streaks occur, which inevitably lead to a reduction in quality of the coating on the web.

In order to clean either the roll surface (indirect application) or the material web surface (direct application), which is to be coated, of such fibers, foreign bodies, dirt or like particles, it has already been suggested to provide a so-called cleaning doctor blade at a distance from the application doctor blade and in a direction opposite to the direction of rotation of the roll, that is, upstream of the application chamber. The particles should be scraped off by the cleaning doctor blade so that blade streaks are prevented upon application of the liquid or pasty medium.

An apparatus with an upstream cleaning doctor blade is already known, for example, from EP 0 319 503. A doctor blade knife is used as the cleaning doctor blade. In the direct vicinity of its effective surface or edge, this blade knife additionally has openings or channels through which the liquid or pasty medium flows out of the application chamber. The arrangement of the openings or channels in the blade knife is such that the discharging liquid or pasty flow of the medium impinges upon the roll or material web surface and rinses away the scraped off particles which may have gathered on that surface. In addition, this rinsing pre-wets the web which improves the quality of the subsequent application of coating.

In practice, relatively good rinsing and pre-wetting effect is achieved by means of this apparatus. However, under certain conditions, particles still collect upstream of or before reaching the cleaning blade knife. These mix with a thickened residual film and air bubbles under unfavorable conditions, and this mixture can build up in this form on the blade knife. In these cases, both the blade knife and the roll are subjected to uneven wear and also produce considerable coating film faults. Additionally, the scraped off particles which build up at the blade knife are taken up for a time by the roll and are pulled under the application blade rod downstream of the application unit, which leads to even greater film faults.

SUMMARY OF THE INVENTION

It is an object of the present invention to further develop an apparatus for applying a liquid or pasty medium, i.e., a coating medium, on a web in such a manner that the collection and buildup of fibers, foreign bodies or similar particles in front (upstream) of the cleaning doctor blade is prevented as much as possible.

This object is achieved according to the invention wherein the cleaning doctor blade has a doctor blade bar which is supported by a blade holder. Openings or channels for the coating medium are provided in the holder so that coating medium cleans and pre-wets the surface to be coated before it passes the coating application chamber.

The invention is based on the concept of using a blade bar instead of a blade knife on the cleaning doctor blade. Tests have shown that fibers, foreign bodies or similar particles collect to a smaller extent at a blade bar than at a blade knife. Surprisingly, the rinsing and pre-wetting effect provided by the blade bar is in this case no worse than when a blade knife is used. Larger collection of fibers, foreign bodies or similar particles do not build up at a blade bar because they are surprisingly continuously removed by the rotational movement of the blade bar. The cleaning doctor blade bar therefore has a "self-cleaning effect".

In the case of indirect application of coating medium to the roll, tests have shown an improvement in the quality of the film of coating material subsequently applied by the roll onto the material web is achieved by using the invention. The cleaning doctor blade bar is also subjected to substantially less wear. The arrangement is also so simple that the manufacturing costs of an apparatus according to the invention are comparatively low.

In principle, the holder for the blade bar of the cleaning doctor blade can be designed in any desirable manner. However, it is useful if the holder has a blade base which receives the blade bar and a holding link which supports this blade base. Such an arrangement is simple in structural terms and allows optimal adaptation to the respective surrounding conditions.

The openings or channels for rinsing and pre-wetting with liquid or pasty medium can be arranged at any desirable location, i.e. in the blade base or in the holding link, or possibly even in both elements.

For specific applications, it can be of advantage that the holding web is curved or bent. One such arrangement may be a two side coating apparatus, which includes two applicator units associated with one roll for coating both sides of the web. One application unit may coat the web directly, while the other may coat the web indirectly. An example can be seen in GB 2 096 025 A. In an arrangement where the holding link is bent, the link can be guided relatively near to the roll or material web surface and the openings or channels can be arranged to achieve an optimal rinsing and pre-wetting effect. If the holding link is additionally flexible, the necessary pressing force of the cleaning doctor blade bar is already ensured alone by the pre-tension of the holder and the cleaning doctor blade bar is supported in the case of a corresponding arrangement by the force of the liquid or pasty medium in the application chamber.

It is not necessary in principle to provide an adjusting means for the holder of the cleaning doctor blade bar. As a result, the manufacturing costs of the application unit can be considerably reduced. However, in order to rebuild an already existing application unit which already has an adjusting means for an overflow or damming bar, as in U.S. Pat. No. 4,848,268, it is useful to use this adjusting means as a holder for the cleaning doctor blade bar. For this purpose, the holding link of the blade holder is simply secured to the available adjusting means. However, in the case of an already existing application unit with a nozzle flap which is designed to move away towards the roll for the purpose of cleaning the application unit, the holder of the cleaning doctor blade can also be secured directly to this flap.

Depending on the intended use, the holder for the cleaning doctor blade bar can be formed in various ways. As initially described, it can be advantageous to form the holder of a blade base as well as a holding link supporting the blade base. However, for certain applications, it can also be useful to integrally form the blade base and the holder.

Tests have shown that it is useful to arrange the cleaning doctor blade bar as close as possible to the application doctor blade. The spacing between the application doctor blade and the cleaning doctor blade is usefully 50 to 100 mm.

Tests have also shown that the blade bar of the cleaning doctor blade should usefully have a diameter of between 10 to 20 mm. In this case, it is advantageous to roughen or profile the blade bar of the cleaning doctor blade.

The blade bar may be driven to rotate by only friction with the roll. In that case, the blade bar rotates counter to the roll. Typically, the blade bar rotates slower than the roll. It is advantageous if the blade bar for the cleaning blade is driven by a motor, preferably one at each end of the blade bar due to the long length of the blade bar. Common transmissions, e.g. gears, transmit motion to the blade bar from the motors, the blade bars may be rotated along with the roll rotation direction or counter to it, and at a selected speed, typically relatively slow as compared with the speed of the roll. In this case, a drive would be provided.

If an application unit is used with an application doctor blade also having a blade bar, it is possible to either drive or not drive that blade bar to rotate, and if driven, to drive it in the manner of the cleaning doctor blade and using similar means, as described above. Where both the cleaning doctor blade and the application doctor blade include blade bars, and where those blade bars are both to be driven, it is advantageous to provide a common drive for the blade bar of the cleaning doctor blade and for the blade bar of the application doctor blade.

For further explanation and better understanding, exemplary embodiments of the invention are described and explained in more detail in the following with reference to the enclosed drawings.

DETAILED DESCRIPTION OF THE PREFERRED EMBODIMENTS

Figure 1:
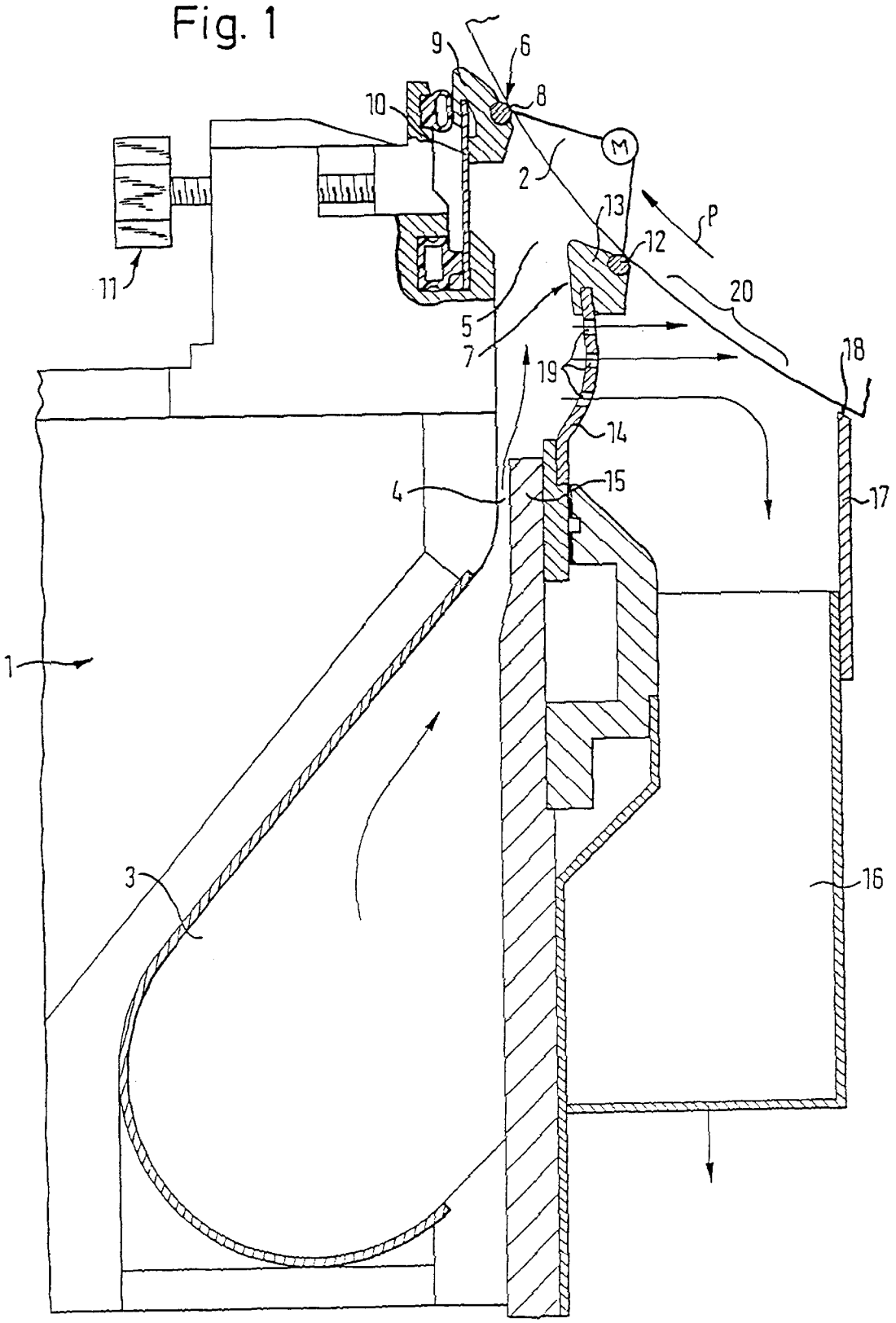
FIG. 1 schematically shows a first exemplary embodiment of the invention for applying a liquid or pasty medium, e.g. a coating.

The embodiment illustrated in FIG. 1 relates to an arrangement for indirectly applying liquid or pasty medium, a coating applicator, for coating a web of paper, cardboard, textile, or the like web materials. See, for example, EP 0 677 613 A2. The application unit 1 is arranged approximately at the eight o'clock position around an application roll 2, which turns clockwise, as shown, in the direction of the arrow P. The application unit 1 has a color distribution channel 3 via which the liquid or pasty coating medium is supplied from the side through a color distribution tube, which is not illustrated.

The liquid or pasty medium passes from the color distribution channel 3 via a nozzle 4 into an application chamber 5, which is substantially bounded by an application doctor blade 6 at the downstream or outlet end of the chamber 5 and a cleaning doctor blade 7 at the upstream or inlet end of the chamber.

The application blade 6 is of a commonly known structure, shown for example in EP 0 677 613 A2 or in U.S. Pat. No. 4,848,268. It has a blade bar 8 that extends across the roll 2 and which is supported in a blade base 9 that is secured in a known manner on a fitting strip and is adjustable by means of a known adjusting means 11 in terms of its position with respect to the application roll 2. The blade bar is optionally rotatable in the blade base and the blade base may include a drive motor or connection to the blade bar 8 for causing it to spin as the roll goes past. The known elements do not require further explanation.

The cleaning blade 7 is arranged at a distance from the application blade 6 in the direction opposite the direction of rotation of the application roll 2. The cleaning blade 7 includes a doctor blade bar 12 in accordance with the invention that extends across the roll 2 and is supported for rotating around its own axis in a blade base 13. As shown schematically in FIG. 1, a motor M is connected, e.g. by a common gear transmission, to each end of one or both of the bars 8 and/or 12 to drive them to rotate either in the direction of or counter to the direction of rotation of the roll 2. The motor M defines a common drive may be provided for rotating both doctor blade bars 8 and 12.

The blade base 13 is secured at the free end of a holding link 14. The other end of the link 14 is secured to the nozzle flap 15, which itself is capable of being closed in a known manner towards the center of the roll for cleaning purposes and is adjustable to set the nozzle 4.

At the side of the nozzle flap 15 opposite the color distribution tube 3, the application unit also has a return trough 16 for coating medium that returns over the blade bar 12 or through the holding link 14. The trough 16 in the usual manner carriers on its upper side a so-called air boundary layer scraper 17 with an edge 18 that extends close to the surface of the application roll 2.

Openings or channels 19 through which excess liquid or pasty medium can flow out of the application chamber 5 pass through the holding link 14 of the cleaning blade 7. Some of the liquid or pasty medium flowing out of the openings or channels 19 impinges upon the surface region 20 of the application roll 2 upstream of and adjacent the cleaning blade 7 outside the application chamber 5 to provide a known rinsing and pre-wetting effect. The liquid or pasty medium scraped from the surface of the application roll 2 by the blade bar 12 of the cleaning doctor blade 7, plus liquid that passed through the link 14 without impinging on roll region 20, plus overflow past the blade bar 12, then passes into the return trough 16 and flows away from there for treatment and reuse.

Figure 2:
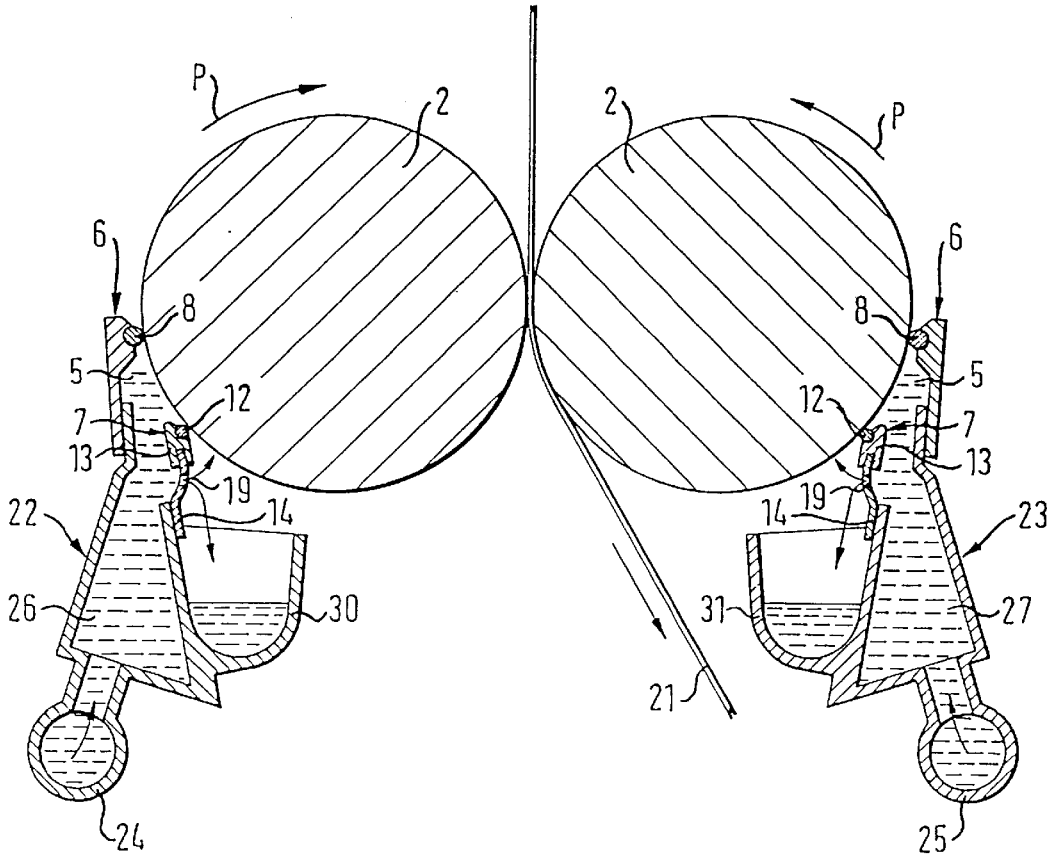
FIG. 2 schematically shows a second exemplary embodiment of the invention.

The embodiment illustrated in FIG. 2 is also an arrangement for indirect application of liquid or pasty medium, in this case sizing or starch, and can be used both as a half or a complete size press, i.e. it is capable of simultaneous application of a coating on both sides of the web or only on one side of the web. See U.S. Pat. No. 4,848,268. Two application rolls 2 and two mirror inverted application units 22 and 23 are provided for coating a material web 21 that is moving downward from above to below. Both application units 22 and 23 are designed similarly to the application unit 1 according to FIG. 1. Each application unit applies medium to the surface of its respective roll in an area before the rolls enter a nip, and the applied medium is then carried by each roll into the nip to coat the respective side of the web. The liquid or pasty medium is supplied to both application units respectively by a supply tube 24 or 25 and enters into a color distribution channel 26 or 27. The liquid or pasty medium then passes into an application chamber 5. As in the embodiment of FIG. 1, the chamber 5 is formed by a downstream application doctor blade 6 with a blade bar 8 and an upstream cleaning doctor blade 7 with a blade bar 12.

The blade bar 12 of the cleaning doctor blade 7 also rests in and is rotatable in a notch or groove in a blade base 13 which forms the holder of the cleaning doctor blade 7 together with a holding link 14 that connects the blade base 13 to the return trough 30. The holding link 14 includes openings or channels 19 through it by means of which the previously described rinsing and pre-wetting effect is achieved. Excess liquid or pasty medium flows away after this process into a return trough 30 or 31 for treatment and reuse.

Figure 3:
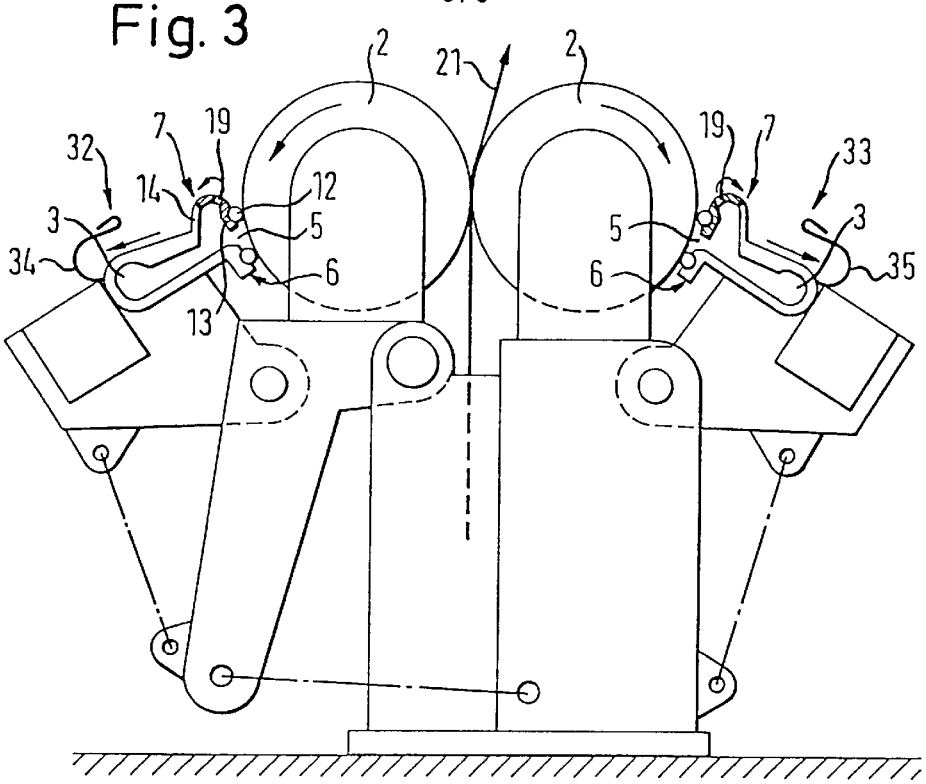
FIG. 3 schematically shows a third exemplary embodiment of the invention.

The embodiment illustrated in FIG. 3 is also an arrangement for indirect application of liquid or pasty medium and can be used either for application on both sides of a web simultaneously or for application only on one side of the web. It is illustrated also in EP 0 677 613 A2.

The material web 21 is fed between two application rolls 2 from below to above. In the four o'clock position on one roll and the eight o'clock position on the other roll, there are coating application units 32 and 33. The arrangement and support of the application units is of known design and therefore does not require further explanation. The liquid or pasty medium is respectively supplied to the application units 32 and 33 by means of a color distributing channel 3 and passes from there into an application chamber 5 which is bounded in this embodiment also by an application doctor blade 6 and a cleaning doctor blade 7.

The cleaning doctor blade 7 includes a blade bar 12 which is supported in a blade base 13. The blade base 13 is fixed to a bent, generally U-shaped holding link 14. The blade base 13 may be adjusted in a conventional manner to adjust the positions of its elements and the tension thereon. The blade base 13 and the holding link 14 are integrally formed and together are equipped with openings or channels 19 through them by means of which liquid or pasty medium discharged from the application chamber 5 is guided onto the surface area of the respective application roll at the inlet side of the chamber 5 adjacent to the cleaning doctor blade to realize the known rinsing and pre-wetting effect.

Excess liquid or pasty medium also flows with the aid of gravitational force into an upper return through 34 or 35, respectively.

Figure 4:
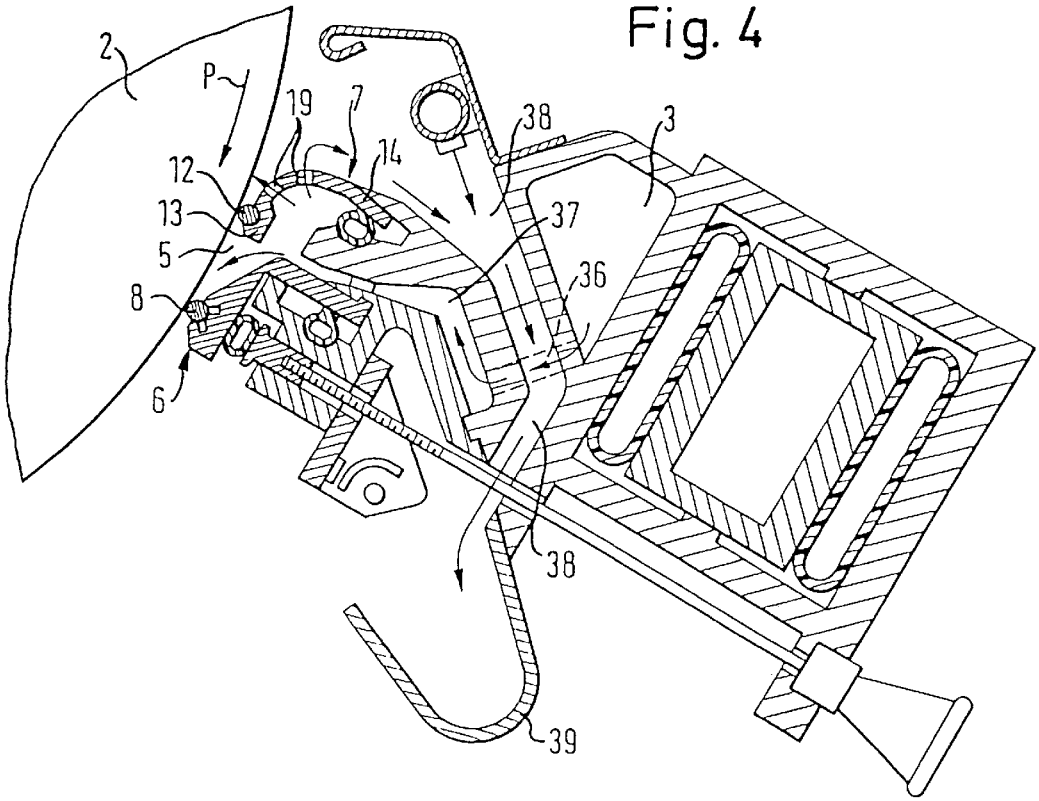
FIG. 4 schematically shows in an enlarged scale the application unit of a fourth exemplary embodiment of the invention.

The application unit illustrated in FIG. 4 is an arrangement which can be used for applying a coating. An example thereof is EP 0 677 613 A2. With regard to the basic arrangement, the application unit according to FIG. 4 corresponds to the application unit 33 of the embodiment according to FIG. 3.

Except for the arrangement in connection with the cleaning doctor blade 7, all elements of this application unit are known from EP 0 677 613 A2. The liquid or pasty medium is supplied by means of a color distributing channel 3 and passes from this channel via bores 36 into a dosing gap 37. The liquid or pasty medium passes via the dosing gap 37 into an application chamber 5 which is bounded by an application doctor blade 6 and a cleaning doctor blade 7 in accordance with the invention.

As with the application unit 33 of the embodiment according to FIG. 3, the cleaning doctor blade 7 is equipped with a blade bar 12 which is seated in a blade base 13 that is integrally formed with a holding link 14. The holding link 14 is bent in the direction towards the surface of the application roll 2 and is provided close to the blade bar 12 with openings or channels 19 which guide the liquid or pasty medium flowing out of the application chamber 5 onto the "run-in" or entrance surface region of the application roll 2 to produce the already described rinsing and pre-wetting effect.

Under the force of gravity, the excess liquid or pasty medium flows in the direction of the arrow through a run off gap 38 into a return trough 39 for treatment and reuse.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for applying a liquid or pasty medium onto a moving web, the apparatus comprising:

a rotating roll having a surface thereon which is selectively usable either for taking up the medium to subsequently transfer the medium to the web or for guiding the web over the roll as the medium is applied directly to the web;

an application unit placed at a section of the surface on the roll for applying the medium either to the roll for subsequent delivery to the web or to the web passing the application unit on the roll;

the application unit comprising:

an application doctor blade and means supporting the application doctor blade at the surface on the roll to which the medium is applied;

a cleaning doctor blade spaced at a distance around the surface on the roll from the application doctor blade in the direction opposite the rotation direction of the roll and therefore upstream of the application doctor blade, so that the application doctor blade and the cleaning doctor blade bound and define an application chamber for the medium to apply the medium in the application chamber to the surface on the roll moving past the application chamber; and means supplying the medium into the application chamber;

the cleaning doctor blade including a blade bar holder located toward the surface on the roll moving past the application unit and including a blade bar supported by the blade bar holder generally at the surface on the roll;

the blade bar holder including a blade base which receives the blade bar and including a holding link that supports the blade base and that extends away from the blade base and from the roll; the holding link being of such material and thickness and being so oriented at and in the vicinity of the blade base as in that vicinity to extend in a direction that enables the holding link to deflect radially of the surface on the roll as it carries the blade bar, as the blade bar rides along the surface of the roll;

at least one of the blade base and the holding link of the blade bar holder having and defining openings or channels therethrough from inside the application chamber to outside thereof, the openings or channels being placed and directed so that the medium exits the application chamber generally in the direction opposite the direction of rotation of the roll and impinges outside the application chamber onto the surface on the roll adjacent to the cleaning doctor blade before the surface on the roll passes the cleaning doctor blade entering the application chamber.

2. The apparatus of claim 1, wherein the blade base and the holding link are integrally formed.

3. The apparatus of claim 1, comprising the openings or channels pass through the holding link.

4. The apparatus of claim 1, wherein the holding link is shaped to be generally curved or bent enabling the radial deflection.

5. The apparatus of claim 4, wherein the holding link is flexible and resilient.

6. The apparatus of claim 1 further comprising means for adjusting the position of and the tension of the holding link and therefore of the blade bar.

7. The apparatus of claim 1, wherein the application doctor blade and the cleaning doctor blade bar are so shaped and positioned that they are spaced apart around the roll a distance of approximately 50–100 mm.

8. The apparatus of claim 1, wherein the blade bar has a surface thereof toward the roll and the surface thereof is roughened or profiled.

9. The apparatus of claim 1, further comprising means for driving the blade bar of the cleaning doctor blade to rotate.

10. The apparatus of claim 1, wherein the application doctor blade includes a second blade bar generally at the surface of the roll and a support for supporting the second blade bar at the surface of the roll.

11. The apparatus of claim 10, further comprising means for driving the blade bar of the cleaning doctor blade to rotate in the holder.

12. The apparatus of claim 11, wherein the driving means is for driving both the blade bar of the cleaning doctor blade to rotate and the second blade bar to rotate.

* * * * *